US006517280B2

(12) United States Patent
Carter

(10) Patent No.: US 6,517,280 B2
(45) Date of Patent: Feb. 11, 2003

(54) SECURITY TOWER

(76) Inventor: Ricky S. Carter, 43317 Moody Dixon Rd., Prairieville, LA (US) 70769

( * ) Notice: Subject to any disclaimer, the term of this patent is extended or adjusted under 35 U.S.C. 154(b) by 0 days.

(21) Appl. No.: 09/899,699

(22) Filed: Jul. 5, 2001

(65) Prior Publication Data

US 2003/0007832 A1 Jan. 9, 2003

(51) Int. Cl.[7] ..... E04H 17/00

(52) U.S. Cl. ..... 404/6; 404/9; 404/12; 256/13.1; 256/DIG. 6; 256/65.02

(58) Field of Search ..... 404/6, 9, 12; 49/34, 49/464; 116/63 R, 63 P; 40/612, 607; 248/122.1, 125.9, 218.4, 219.3; 256/1, 13.1, 19, 59, 65.02, 65.03, 65.04, 65.07, 65.08, 66, 67

(56) References Cited

U.S. PATENT DOCUMENTS

| | | | | | |
|---|---|---|---|---|---|
| 54,794 | A | * | 5/1866 | Thompson | 256/26 |
| 1,998,520 | A | | 4/1935 | Penote | |
| 2,392,011 | A | | 1/1946 | Stringer | |
| 2,613,463 | A | | 10/1952 | Transue | |
| 3,119,588 | A | | 1/1964 | Keats | |
| 3,950,873 | A | | 4/1976 | Shehle et al. | |
| 4,007,919 | A | | 2/1977 | Totten | |
| 4,050,401 | A | | 9/1977 | Kelly | |
| 4,071,224 | A | | 1/1978 | Gilbert | |
| 4,109,910 | A | | 8/1978 | Gleason | |
| 4,394,005 | A | | 7/1983 | Stewart | |
| 4,890,952 | A | | 1/1990 | Jones | |
| 4,968,177 | A | | 11/1990 | Bechtold | |
| 5,123,773 | A | | 6/1992 | Yodock | |
| 5,197,408 | A | | 3/1993 | Stoudt | |
| 5,224,241 | A | * | 7/1993 | Williams | 16/253 |
| 5,460,353 | A | | 10/1995 | Rittenhouse | |
| 5,484,225 | A | | 1/1996 | Warner | |
| 6,014,941 | A | | 1/2000 | Bent et al. | |
| D445,054 | S | | 7/2001 | Despino | |
| 6,336,623 | B1 | * | 1/2002 | McCarthy | 256/64 |
| 6,375,385 | B1 | * | 4/2002 | Kennedy | 116/63 R |

FOREIGN PATENT DOCUMENTS

| | | |
|---|---|---|
| GB | 2256443 A | 12/1992 |
| GB | 2287735 A | 9/1995 |

* cited by examiner

*Primary Examiner*—David Bagnell
*Assistant Examiner*—Sunil Singh
(74) *Attorney, Agent, or Firm*—David L. Ray

(57) ABSTRACT

A tower for preventing people and equipment from entering a restricted area, the security tower including a vertical post connected to a base, the post being constructed from a rigid material, the post having at least one hollow channel therethrough for receiving a flexible elongated barrier material, the post having at least one pair of shoulders extending horizontally from the sides of the post, and each of the pair of shoulders having a pin extending vertically upward therefrom.

20 Claims, 4 Drawing Sheets

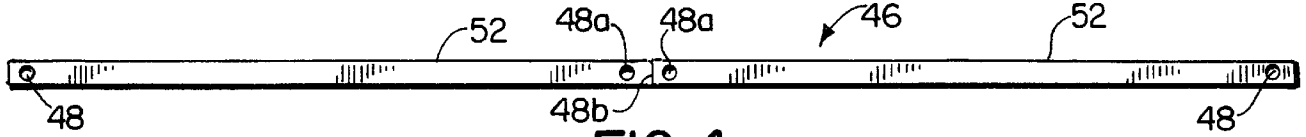
FIG. 4.
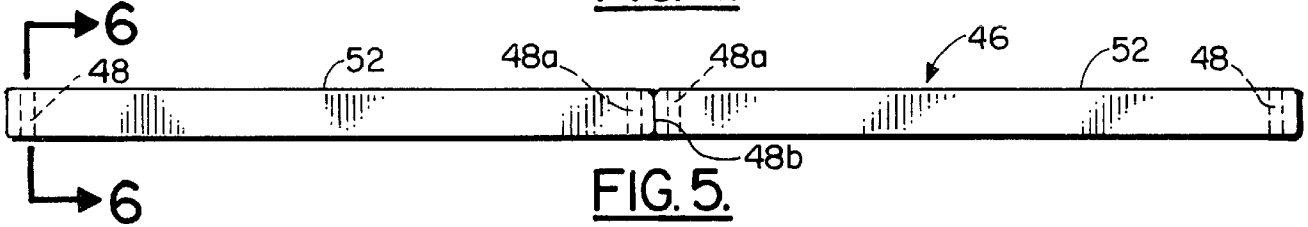
FIG. 5.
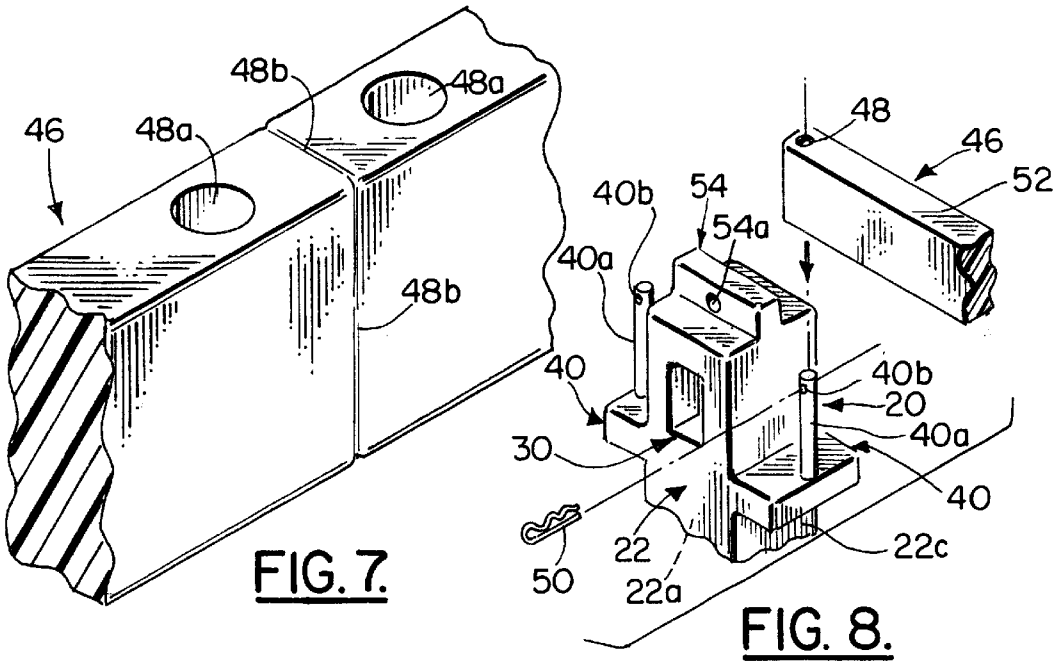
FIG. 7.
FIG. 8.
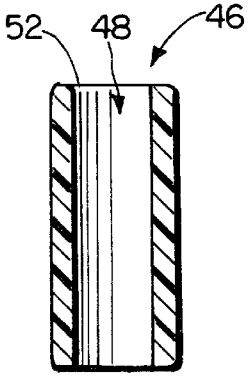
FIG. 6

SECURITY TOWER

BACKGROUND OF THE INVENTION

1. Field of the Invention

The present invention relates to security towers or posts for delineating or marking restricted areas in industrial plants, construction sites, roadways, and the like. More particularly, the present invention is related to vertical posts and optionally barricades to prevent personnel from entering a restricted area.

2. Description of the Related Art

Various devices and implements are known in the art for delineating or marking restricted or dangerous areas in industrial plants, construction sites, roadways, and the like. See for example U.S. Pat. Nos. 1,998,520; 2,392,011; 2,613,463; 3,119,588; 3,950,873; 4,007,919; 4,050,401; 4,071,224; 4,109,910; 4,394,005; 4,890,952; 4,968,177; 5,123,773; 5,197,408; 5,484,225; 5,640,353; 6,014,941; and UK Patent Applications GB 2 287 735 A and GB 2 256 443 A.

SUMMARY OF THE INVENTION

It is an object of the present invention to provide a security tower for preventing people and equipment from entering a restricted area.

It is a further object of the invention to provide a security tower which may have rigid barricades or flexible elongated barrier material connected thereto for restricting access to a designated area.

It is an additional object of the invention to provide a novel rigid barricade for utilization with the security tower of the invention.

In accordance with the present invention there is provided a security tower for preventing people and equipment from entering a restricted area, the security tower including a vertical post connected to a base, the post having at least one hollow channel therethrough for receiving a flexible elongated barrier material, the post having at least one pair of shoulders extending horizontally from the sides of the post, each of the pair of shoulders having a pin extending vertically upward therefrom for connecting a rigid horizontal beam thereto.

In another embodiment of the invention there is provided a beam having a vertical hollow sleeve formed in each end thereof adapted to receive the pin on the shoulder therein, and preferably two vertical parallel hollow sleeves formed adjacent on a centerline formed on the barricade beam to enable the barricade beam to be cut into two equal length beams to provide more versatility in constructing barricades.

BRIEF DESCRIPTION OF THE DRAWINGS

FIG. 4 is a top plan view of a barricade beam of the invention;

FIG. 5 is a side plan view of the barricade beam of the invention;

FIG. 6 is a cross-sectional view taken along lines 6—6 of FIG. 5;

FIG. 7 is a partly cut-away perspective view of the center portion of the barricade beam of the invention;

FIG. 8 is a partly cut-away perspective view of the top portion of the security tower of the invention showing the barricade beam of the invention aligned with a pin on a shoulder of the security tower prior to connecting the barricade beam to the security tower;

DETAILED DESCRIPTION OF THE INVENTION

Figure 11:
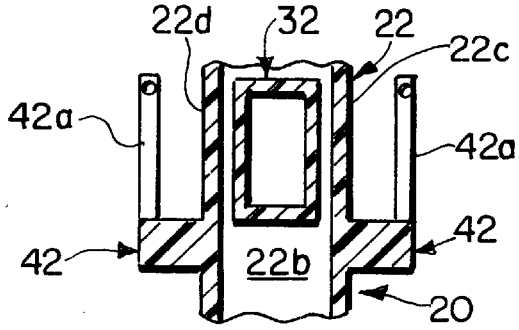
FIG. 11 is a cross-sectional view taken along lines 11—11 of FIG. 10.
Figure 12:
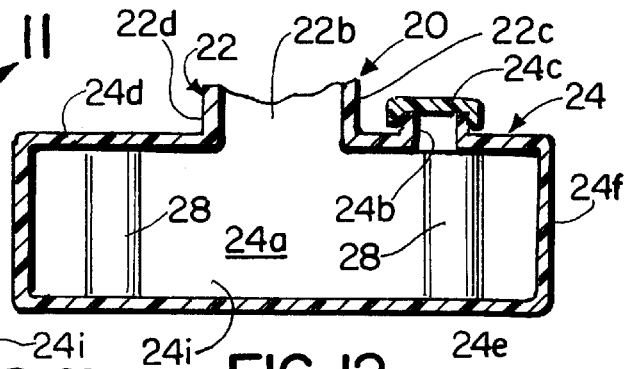
FIG. 12 is a cross-sectional view taken along lines 12—12 of FIG. 10.

Referring now to the drawings, and in particular to FIGS. 1–3 and 10–12, there is shown the security tower assembly of the invention generally indicated by the numeral 20. Security tower assembly 20 has a vertical post generally indicated by the numeral 22 rigidly connected to a base generally indicated by the numeral 24. Preferably, base 24 is hollow inside, having reservoir 24*a* therein as shown in FIG. 12 which can be filled with water or other weighting material through threaded filler opening 24*b* covered by threaded cap 24*c*. Reservoir 24*a* can be filled with other weighting material such as liquids, concrete, or granular material such as sand, to add sufficient weight to base 24 to prevent security tower 20 from being easily tipped over by wind, ground vibration, or the like when security tower 20 is being used to restrict access to a selected area. Base 24 can be made of any desired volume to provide the desired weight to security tower 20.

Preferably, base 24 is generally rectangular in shape although if desired base 24 could be any desired shape such as circular, oval, or the like. As shown in FIGS. 1–3, 9, 10, and 12, base 24 has a generally rectangular top 24*d* and a generally rectangular bottom 24*e*. Base 24 has two opposing rectangular sidewalls 24*f* and 24*g*, and two opposing sidewalls 24*h* and 24*i*. Preferably, sidewalls 24*h* and 24*i* each have two vertical spaced-apart parallel slots 26—26 and 28—28 therein for receipt of an anchoring peg, stake, or bolt (not shown) which could be placed in slots 26—26 or 28—28 to anchor security tower 20 to the surface upon which it is placed. Slots 26—26 and 28—28 could be omitted if desired.

Extending vertically upward from base 24 is post 22. Post 22 is preferably generally rectangular in cross-section, although post 22 could have any desired cross-section such as circular, oval, or the like. Post 22 is preferably hollow inside as shown in FIGS. 11 and 12. Post 22 has two opposing generally rectangular sides 22*a* and 22*b* which are rigidly connected to opposing generally rectangular sides 22*c* and 22*d*.

Figure 13:
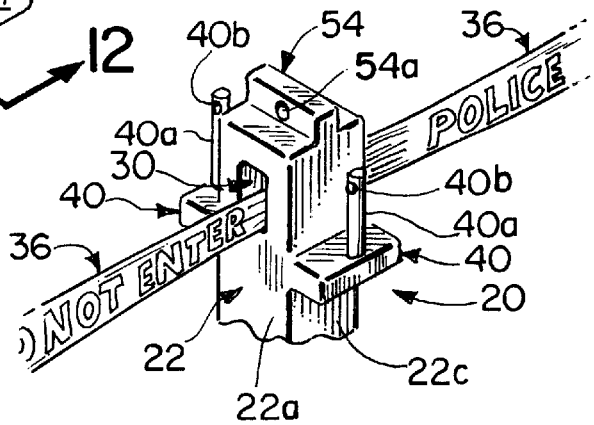
FIG. 13 is a partly cut-away perspective view of the top portion of the security tower of the invention showing the a flexible elongated security tape placed through an opening in the security tower of the invention to restrict entry into an area.
Figure 14:
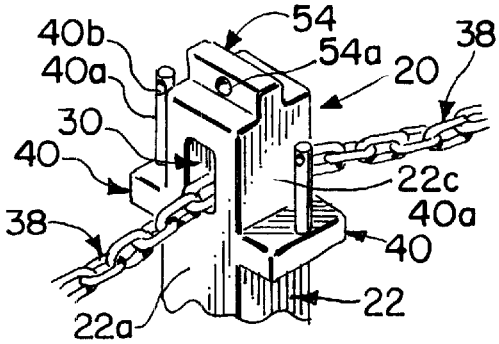
FIG. 14 is a partly cut-away perspective view of the top portion of the security tower of the invention showing the a flexible elongated security chain placed through an opening in the security tower of the invention to restrict entry into an area.

Opposing sides 22*a* and 22*b* of post 22 preferably have a plurality of hollow channels generally indicated by the numerals 30, 32 and 34 extending therebetween for receipt of a flexible elongated barrier material such as the warning ribbon generally indicated by the numeral 36 as shown in FIG. 13 or a chain generally indicated by the numeral 38 as shown in FIG. 14. If desired, a single channel such as channel 30 could be formed in post 22, and channels 32 and 34 could be omitted. Hollow channels 30, 32, and 34 are shown in the drawings to have a preferred rectangular cross-section; however, hollow channels 30, 32, and 34 could have any desired cross-section such as circular, oval, or the like.

Other flexible elongated barrier materials could be utilized instead of ribbon 36 or chain 38 if desired such as a rope, string, cable, or the like. Warning ribbon 36 or chain 38, or other flexible elongated barrier materials, may be strung through channels 30 of a plurality of adjacent security towers 20 which have been placed around the border of a restricted area to prevent personnel and equipment from entering the restricted area. If desired, additional flexible elongated barrier materials may be strung through channels 32 and/or 34 of a plurality of adjacent security towers 20 which have been placed around the border of a restricted area to prevent personnel and equipment from entering the restricted area.

Opposing sides 22*c* and 22*d* of post 22 preferably have a plurality of pairs of shoulders lying in a plane generally indicated by the numerals 40—40, 42—42, and 44—44 extending horizontally outward therefrom, each one of the shoulders having a pin 40*a*, 42*a*, and 44*a* respectively extending vertically upward therefrom. Preferably, pins 40*a*, 42*a*, and 44*a* are cylindrical in shape as shown in the drawings; however, pins 40*a*, 42*a*, and 44*a* could be of any desired cross-section such as oval, rectangular, or the like. Shoulders 40—40, 42—42, and 44—44 and their associated pins 40*a*, 42*a*, and 44*a* are adapted to connect to the barricade beam generally indicated by the numeral 46 in FIGS. 4–9.

If desired, a single set of shoulders such as shoulders 40—40 could be formed on post 22, and shoulders 42—42 and 44—44 could be omitted. Also, if desired, two sets of shoulders such as shoulders 40—40 and 42—42 could be formed on post 22, and shoulders 44—44 could be omitted. Shoulders 40—40, 42—42, 44—44 are shown in the drawings to have a preferred rectangular cross-section; however, shoulders 40—40, 42—42, 44—44 could have any desired cross-section such as circular, oval, or the like.

Figure 1:
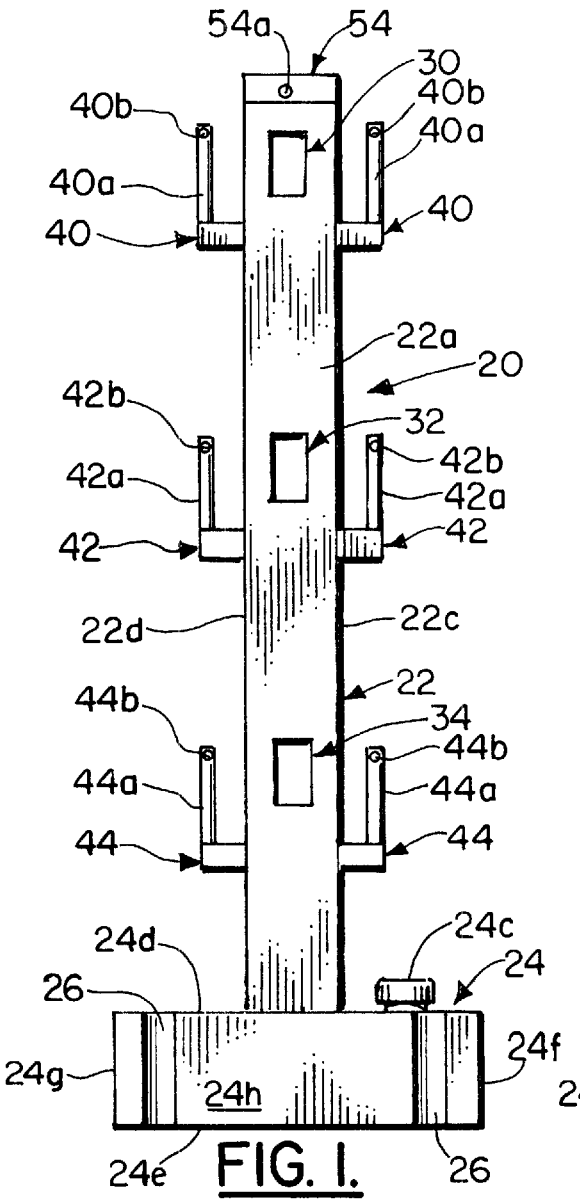
FIG. 1 is shown an elevational plan view of the security tower of the invention.
Figure 2:
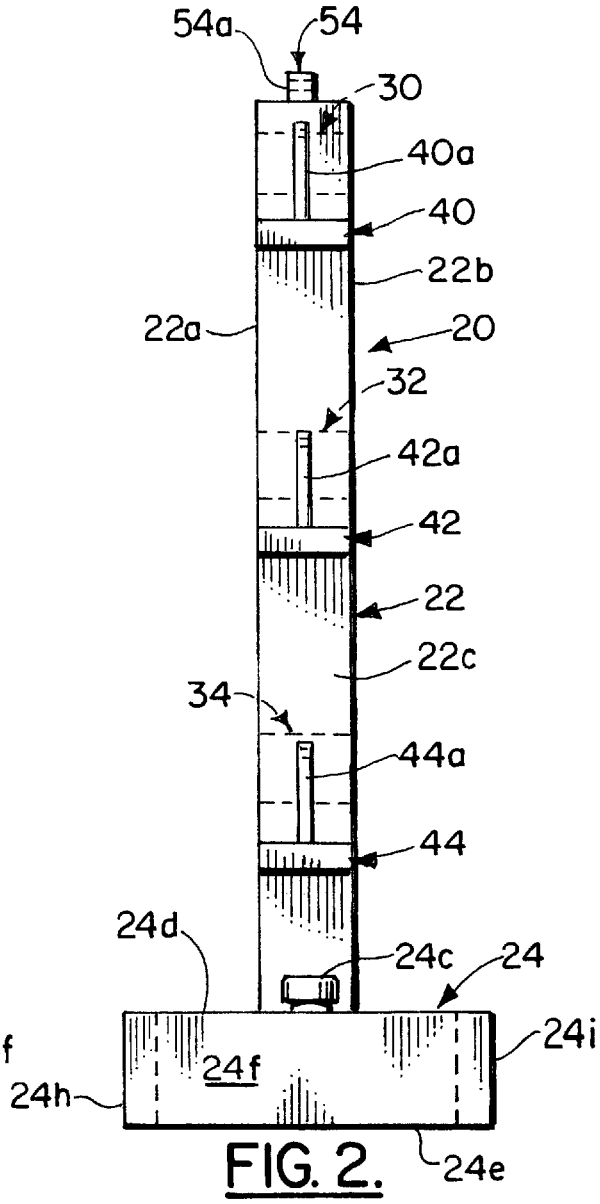
FIG. 2 is an elevational plan view of the security tower of the invention rotated 90 degrees about its vertical axis from the position shown in FIG. 1.
Figure 3:
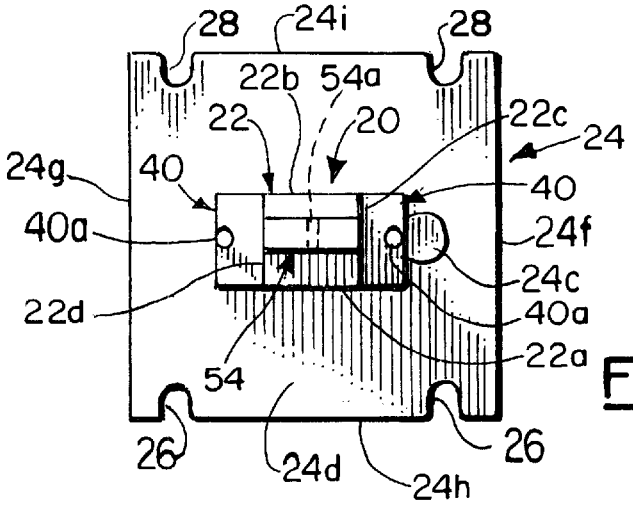
FIG. 3 is top view of the security tower of the invention shown in FIG. 1.
Figure 9:
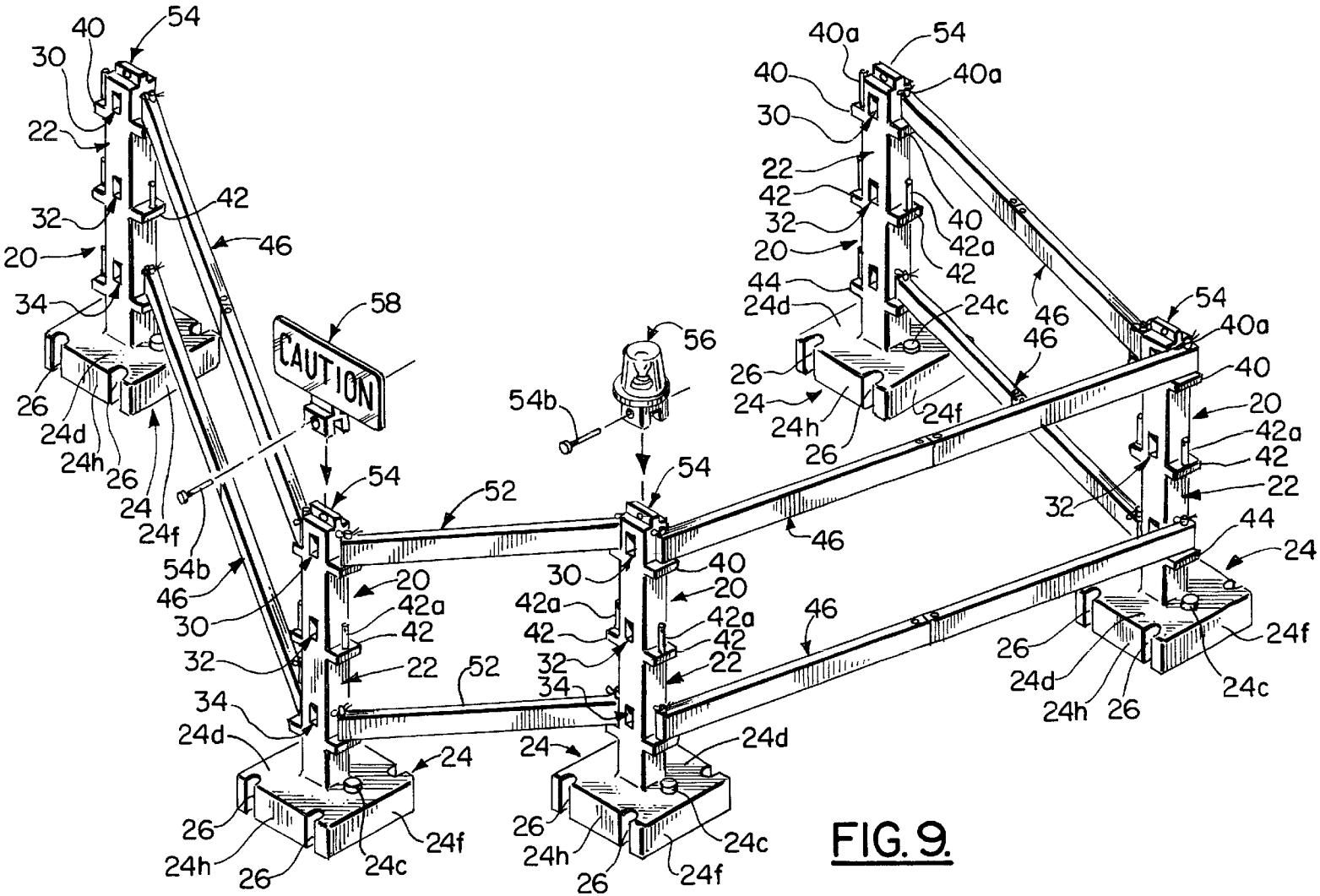
FIG. 9 is a perspective view of a plurality of security towers and barricade beams of the invention connected together to prevent people and equipment from entering a selected area.
Figure 10:
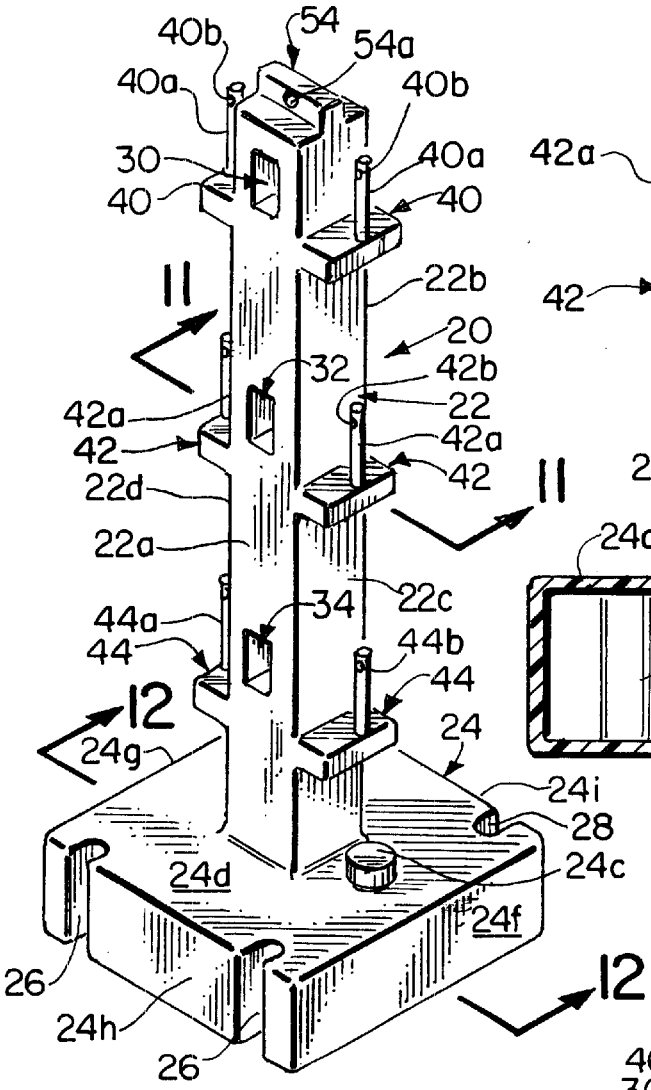
FIG. 10 is a perspective view of the security tower of the invention.

Barricade beam 46 has a vertical hollow sleeve 48 formed in each end thereof adapted to receive pin 40*a*, 42*a*, or 44*a* therein as shown in FIGS. 8 and 9, and preferably two vertical parallel hollow sleeves 48*a*—48*a* formed adjacent the centerline 48*b* formed on barricade beam 46. Preferably, hollow sleeves 48—48 and 48*a*—48*a* are cylindrical in shape. Hollow sleeves 48*a*—48*a* and centerline 48*b* are preferred to enable barricade beam to be cut into two equal length beams 52 shown in FIGS. 4, 5, and 9 which would be one-half the length of barricade beam 46 to provide more versatility in constructing barricades such as that shown in FIG. 9; however, if desired, hollow sleeves 48*a*—48*a* and centerline 48*b* could be omitted from barricade beam 46. If desired, any elongated generally rectangular beam such as a common wooden or plastic beam could be used as a barricade beam between adjacent security towers 20—20 if the beam had vertical hollow channels drilled at the ends thereof similar to channels 48 which could receive pins 40*a*, 42*a*, or 44*a*.

As shown in FIG. 8, to connect barricade beam 46 or 52 to security tower 20, sleeve 48 of barricade beam 46 is aligned with pin 40*a* (or pin 42*a* or pin 44*a*), and sleeve 48 is moved vertically downward onto pin 40*a*. Preferably, each of the pins 40*a*, 42*a*, and 44*a* have a horizontal hollow cylindrical channel 40*b*, 42*b*, and 44*b*, respectively, therein for receipt of fastener pin 50. Any desired fastener such as a nut and bolt, wire, or the like could be substituted for fastener pin 50. If desired, horizontal channel 40*b*, 42*b*, and 44*b* could be omitted. Hollow cylindrical channels 40*b*, 42*b*, and 44*b* are shown in the drawings to have a preferred cylindrical shape with a circular cross-section; however, hollow channels 40*b*, 42*b*, and 44*b* could have any desired cross-section such as circular, oval, or the like, so long as pins 40*a*, 42*a*, and 44*a* could be received therein.

At the top of post 22 is preferably a generally rectangular bar or ridge generally indicated by the numeral 54 to enable a warning device such as the light generally indicated by the numeral 56 or the sign generally indicated by the numeral 58 as shown in FIG. 9 to be connected thereto. Preferably, bar or ridge 54 has horizontal hollow cylindrical channel 54*a* therein for receipt of fastener pin 54*b* shown in FIG. 9. Any desired fastener such as a nut and bolt, wire, or the like could be substituted for fastener pin 54*b*. If desired, bar or ridge 54 or hollow cylindrical channel 54*a* could be omitted.

In many applications, a flexible elongated barrier material such as warning ribbon 36 or chain 38 strung through one or more of the channels 30, 32, and 34 of a plurality of adjacent security towers 20 which have been placed around the border of a restricted area is sufficient to comply with safety requirements of an industrial plant or other location for preventing personnel and equipment from entering the restricted area.

Also, in many applications, rigid barricade beams similar to barricade beam 46 are desired or required rather than flexible elongated barrier material such as warning ribbon 36 or chain 38 to be attached to a plurality of adjacent security towers 20 which have been placed around the border of a restricted area is sufficient to comply with safety requirements of an industrial plant or other location for preventing personnel and equipment from entering the restricted area. In FIG. 9 is shown a barricade constructed with the security tower 20 of the invention and the barricade beams 46 and 52 of the invention. The security tower 20 of the invention is thus very versatile and enables entry into an area to be restricted by flexible elongated barrier material or by barricade beams connected to adjacent security towers 20.

Preferably the security tower 20 of the invention and the barricade beam 46 of the invention are molded from a plastic or polymeric material by injection molding or the like.

Although the preferred embodiments of the invention have been described in detail above, it should be understood that the invention is in no sense limited thereby, and its scope is to be determined by that of the following claims:

What is claimed is:

1. A security tower for preventing people and equipment from entering a restricted area, said security tower comprising:

a. a base for placement on the surface of said restricted area, and b. a post rigidly connected to said base, said post having a top end and a bottom end, said bottom end of said post being connected to said base, said post being aligned vertically to said base, said post having at least one hollow channel having a rectangular cross-section extending therethrough for receiving a flexible elongated barrier material, said post having at least one pair of shoulders connected thereto, each one of said at least one pair of shoulders lying in the same plane and extending horizontally outward from opposing sides of said post, each one of said at least one pair of shoulders having an elongated pin connected thereto and extending vertically upward therefrom, said pin being adapted for receipt in a barricade beam having an elongated hollow sleeve formed therein for receipt of said pin.

2. The security tower of claim 1 wherein said base is hollow.

3. The security tower of claim 2 wherein said base has an opening therein for receipt of weighting material.

4. The security tower of claim 3 wherein said opening has a removable cap for covering said opening.

5. The security tower of claim 1 wherein said post is hollow.

6. The security tower of claim 5 wherein said post is generally rectangular in cross-section.

7. The security tower of claim 6 wherein said post has two opposing generally rectangular sides having said hollow channel extending therethrough, said two opposing generally rectangular sides having said hollow channel extending therethrough being connected to said two generally rectangular opposing sides having one of said at least one pair of shoulders connected thereto.

8. The security tower of claim 7 wherein said post has a ridge at the top end thereof for receiving a warning device.

9. The security tower of claim 8 wherein said ridge has a hollow channel therein for receiving a fastener for connecting said warning device to said ridge.

10. The security tower of claim 9 wherein said pin has a hollow channel therein for receiving a fastener for preventing said barricade beam from being removed from said pin.

11. A security tower for preventing people and equipment from entering a restricted area, said security tower comprising:

a. a base means for placement on the surface of said restricted area, and b. a post means rigidly connected to said base means, said post means having a top end and a bottom end, said bottom end of said post means being connected to said base means, said post means being aligned vertically to said base means, said post means having at least one hollow channel means having a rectangular cross-section extending therethrough for receiving a flexible elongated barrier material means, said post means having at least one pair of shoulder means connected thereto, each one of said at least one pair of shoulder means lying in the same plane and extending horizontally outward from opposing sides of said post means, each one of said at least one pair of shoulder means having an elongated pin means connected thereto and extending vertically upward therefrom, said pin means being adapted for receipt in a barricade beam having an elongated hollow sleeve formed therein for receipt of said pin means.

12. The security tower of claim 11 wherein said base means is hollow.

13. The security tower of claim 12 wherein said base means has an opening means therein for receipt of weighting material.

14. The security tower of claim 13 wherein said opening means has a removable cap means for covering said opening means.

15. The security tower of claim 14 wherein said post means is hollow.

16. The security tower of claim 15 wherein said post means is generally rectangular in cross-section.

17. The security tower of claim 16 wherein said post means has two opposing generally rectangular sides having said hollow channel means extending therethrough, said two opposing generally rectangular sides having said hollow channel means extending therethrough being connected to said two generally rectangular opposing sides having one of said at least one pair of shoulder means connected thereto.

18. The security tower of claim 17 wherein said post means has a ridge means at the top end thereof for receiving a warning device.

19. The security tower of claim 18 wherein said ridge means has a hollow channel therein for receiving a fastener for connecting said warning device to said ridge means and wherein said pin means has a hollow channel means therein for receiving a fastener for preventing said barricade beam from being removed from said pin means.

20. A security tower for preventing people and equipment from entering a restricted area, said security tower comprising:

a. a hollow base for placement on the surface of said restricted area, said hollow base having an opening therein for receipt of a weighting material, said opening having a removable cap for covering said opening, and b. a hollow post rigidly connected to said base, said post being generally rectangular in cross-section, said post having a top end and a bottom end, said bottom end of said post being connected to said base, said post being aligned vertically to said base, said post having at least one hollow channel having a rectangular cross-section extending therethrough for receiving a flexible elongated barrier material, said post having at least one pair of shoulders connected thereto, each one of said at least one pair of shoulders lying in the same plane and extending horizontally outward from opposing sides of said post, each one of said at least one pair of shoulders having an elongated pin connected thereto and extending vertically upward therefrom, said pin being adapted for receipt in a barricade beam having an elongated hollow sleeve formed therein for receipt of said pin, said post having two opposing generally rectangular sides having said hollow channel extending therethrough, said two opposing generally rectangular sides having said hollow channel extending therethrough being connected to said two generally rectangular opposing sides having one of said at least one pair of shoulders connected thereto, said post having a ridge at the top end thereof for receiving a warning device, said ridge having a hollow channel therein for receiving a fastener for connecting said warning device to said ridge, said pin having a hollow channel therein for receiving a fastener for preventing said barricade beam from being removed from said pin.

* * * * *